US011613985B2

(12) United States Patent
Rendusara et al.

(10) Patent No.: US 11,613,985 B2
(45) Date of Patent: Mar. 28, 2023

(54) WELL ALARMS AND EVENT DETECTION

(71) Applicant: Sensia LLC, Houston, TX (US)

(72) Inventors: Dudi Abdullah Rendusara, Singapore (SG); Luis Parra, Houston, TX (US); Roderick Ian MacKay, London (GB); Ming-Kei Keith Lo, Nisku (CA); Jeffery Anderson, Beaumont (CA)

(73) Assignee: Sensia LLC, Houston, TX (US)

( * ) Notice: Subject to any disclaimer, the term of this patent is extended or adjusted under 35 U.S.C. 154(b) by 54 days.

(21) Appl. No.: 15/035,698

(22) PCT Filed: Nov. 13, 2014

(86) PCT No.: PCT/US2014/065338

§ 371 (c)(1),
(2) Date: May 10, 2016

(87) PCT Pub. No.: WO2015/073600

PCT Pub. Date: May 21, 2015

(65) Prior Publication Data

US 2016/0281479 A1 Sep. 29, 2016

Related U.S. Application Data

(60) Provisional application No. 61/903,941, filed on Nov. 13, 2013.

(51) Int. Cl.
*E21B 47/008* (2012.01)
*E21B 43/12* (2006.01)
(Continued)

(52) U.S. Cl.
CPC ..... *E21B 47/008* (2020.05); *E21B 43/128* (2013.01); *G08B 21/182* (2013.01); *E21B 47/06* (2013.01); *E21B 47/07* (2020.05)

(58) Field of Classification Search
CPC .... E21B 43/128; E21B 47/0007; E21B 47/06; E21B 47/065; E21B 47/008; E21B 47/07; G08B 21/182
See application file for complete search history.

(56) References Cited

U.S. PATENT DOCUMENTS 4,821,580 A 4/1989 Jorritsma
5,353,646 A 10/1994 Kolpak
(Continued)

FOREIGN PATENT DOCUMENTS

RU 2368772 C1 9/2009
WO 2008069695 A2 6/2008
(Continued)

OTHER PUBLICATIONS

PCT/US2014/065338, International Search Report and Written Opinion, dated Mar. 31, 2015, 15 pgs.
(Continued)

*Primary Examiner* — Michael R Wills, III
*Assistant Examiner* — Neel Girish Patel
(74) *Attorney, Agent, or Firm* — Foley & Lardner LLP

(57) ABSTRACT

A technique facilitates smart alarming, event detection, and/or event mitigation. The smart alarming may be achieved by, for example, automating detection processes and using advanced signal processing techniques. In some applications, event detection is enhanced by combining different alarms to facilitate diagnosis of a condition, e.g. a pump condition. The occurrence of certain unwanted events can be mitigated by automatically adjusting operation of a well system according to suitable protocols for a given event.

20 Claims, 5 Drawing Sheets

(51) Int. Cl.

| | |
|---|---|
| ***G08B 21/18*** | (2006.01) |
| ***E21B 47/07*** | (2012.01) |
| ***E21B 47/06*** | (2012.01) |

(56) References Cited

U.S. PATENT DOCUMENTS

| | | | | |
|---|---|---|---|---|
| 5,466,127 | A | 11/1995 | Arnswald | |
| 5,668,420 | A | 9/1997 | Lin et al. | |
| 5,952,569 | A | 9/1999 | Jervis et al. | |
| 7,114,557 | B2 * | 10/2006 | Cudmore | E21B 43/128 166/52 |
| 7,117,120 | B2 | 10/2006 | Beck et al. | |
| 7,258,164 | B2 | 8/2007 | Rezgui et al. | |
| 7,562,723 | B2 | 7/2009 | Reitsma | |
| 8,527,219 | B2 | 9/2013 | Camilleri | |
| 9,476,742 | B2 | 10/2016 | Camilleri | |
| 2002/0145423 | A1 * | 10/2002 | Yoo | G01N 27/82 324/221 |
| 2004/0064292 | A1 | 4/2004 | Beck et al. | |
| 2005/0031443 | A1 | 2/2005 | Ohlsson et al. | |
| 2005/0216229 | A1 | 9/2005 | Huang et al. | |
| 2006/0052903 | A1 | 3/2006 | Bassett | |
| 2007/0150113 | A1 | 6/2007 | Wang et al. | |
| 2007/0175633 | A1 * | 8/2007 | Kosmala | E21B 47/008 166/250.15 |
| 2007/0221173 | A1 | 9/2007 | Hazama | |
| 2007/0252717 | A1 | 11/2007 | Fielder | |
| 2007/0289740 | A1 * | 12/2007 | Thigpen | E21B 43/00 166/250.01 |
| 2008/0067116 | A1 | 3/2008 | Anderson et al. | |
| 2008/0260540 | A1 | 10/2008 | Koehl | |
| 2009/0000789 | A1 | 1/2009 | Leuthen et al. | |
| 2009/0044938 | A1 | 2/2009 | Crossley et al. | |
| 2009/0173166 | A1 | 7/2009 | Genosar | |
| 2009/0223662 | A1 | 9/2009 | Shaw et al. | |
| 2009/0250210 | A1 | 10/2009 | Allen et al. | |
| 2010/0206039 | A1 * | 8/2010 | Kates | G08B 29/26 73/1.01 |
| 2010/0247335 | A1 * | 9/2010 | Atherton | F04D 13/10 417/53 |
| 2010/0263442 | A1 * | 10/2010 | Hsu | G01N 33/2823 73/152.55 |
| 2011/0106452 | A1 | 5/2011 | Anderson et al. | |
| 2011/0168391 | A1 | 7/2011 | Saleri et al. | |
| 2013/0025940 | A1 * | 1/2013 | Grimmer | E21B 21/08 175/48 |
| 2013/0090853 | A1 | 4/2013 | Anderson | |
| 2016/0265321 | A1 | 9/2016 | Elmer | |
| 2017/0363088 | A1 | 12/2017 | Nguyen et al. | |

FOREIGN PATENT DOCUMENTS

| | | | |
|---|---|---|---|
| WO | 20080150811 | A1 | 12/2008 |
| WO | WO-2018/129349 | A1 | 7/2018 |

OTHER PUBLICATIONS

2007 ESP Workshop Agenda, ESP Workshop, Apr. 26, 2007, Woodland, TX USA, 3 pages.

Bolin, Using The Calibrated-Tested Pumping Instrument (Electrical Submersible Pump) For Continuous Fluid Measurement When Producing Heavy Oil Wells, ESP Workshop, Apr. 26, 2007, The Woodlands, TX, USA.

Camilleri, et al., "First Installation of Five ESPs Offshore Romania—A Case Study and Lesson Learned," SPE127593, Intelligent Energy Conference and Exhibition held in Utrecht, The Netherlands, Mar. 23-25, 2010.

Camilleri, et al., "First installation of Five ESPs Offshore Romania—A Case Study and Lesson Learned," Petrom_ESP, Apr. 29-May 1, 2009, pp. 1-22.

Olsen, et al., "Production Allocation Using ESP in the Peregrino Field," SPE Gulf Coast Section Electric Submersible Pump Workshop, The Woodlands, TX, Apr. 25-29, 2011.

CA Examination Report in CA Appl. Ser. No. CA 2930426 dated Jan. 5, 2021 (3 pages).

International Preliminary Report on Patentability for PCT Appl. Ser. No. PCT/US2014/065338, dated May 17, 2016 (10 pages).

Saudi Arabian Examination Report for Application No. SA516371113 dated Jul. 25, 2020, 5 pages (No English Translation).

International Preliminary Report on Patentability on PCT Appl. Ser. No. PCT/US2019/055017 dated Apr. 8, 2021, (8 pages).

International Search Report and Written Opinion on PCT Appl. Ser. No. PCT/US2019/055017 dated Jan. 31, 2020 (9 pages).

* cited by examiner

WELL ALARMS AND EVENT DETECTION

CROSS-REFERENCE TO RELATED APPLICATIONS

The present document is based on and claims priority to U.S. Provisional Application Ser. No. 61/903,941 filed Nov. 13, 2013, which is incorporated herein by reference in its entirety.

BACKGROUND

Various well installations may be equipped with control and monitoring equipment. For example, electric submersible pump (ESP) installations may be equipped with devices for monitoring flow, pressure, temperature, or other operational parameters. The devices may comprise a variety of gauges and sensors deployed both downhole with the electric submersible pump and on the surface to detect and monitor the desired parameters. Additionally, the control and monitoring equipment may be programmed with alarm set points based on knowledge of prior installations and equipment behavior. However, existing alarm systems tend to be static and do not factor in changing local conditions or changing well environments. Consequently, traditional alarm systems may be prone to false positive alarms which are triggered due to changes in local conditions or well environments rather than in response to an actual occurrence of equipment or operational abnormalities.

SUMMARY

In general, a system and methodology are provided for facilitating smart alarming, event detection, and/or event mitigation. The smart alarming may be achieved by, for example, automating detection processes and using advanced signal processing techniques. In some applications, event detection is enhanced by combining different alarms to facilitate diagnosis of a condition, e.g. a pump condition. The occurrence of certain unwanted events can be mitigated by automatically adjusting operation of a well system according to suitable protocols for a given event.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
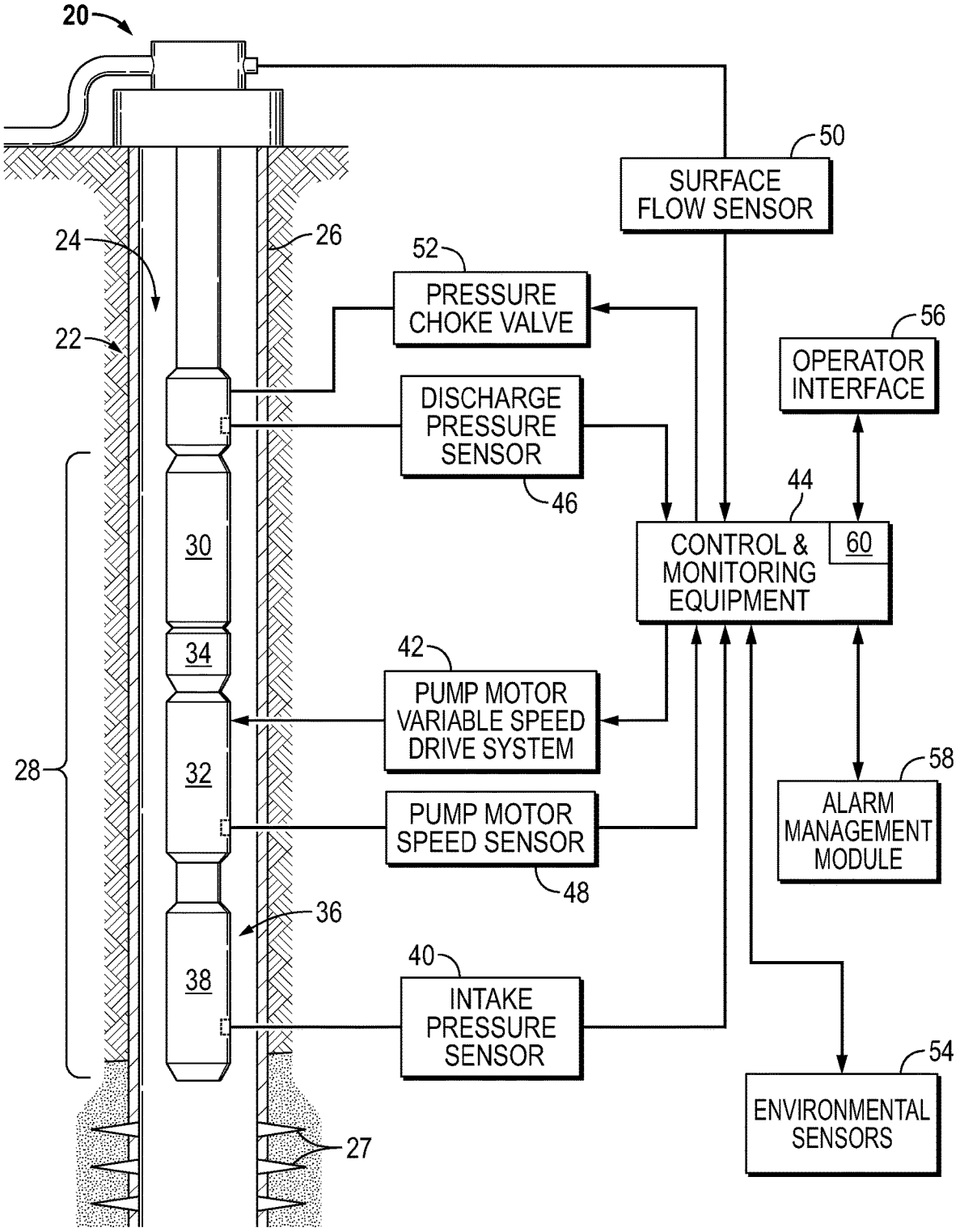
FIG. 1 is an illustration of an example of a well system that may be used for dynamic alarm setting, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology for facilitating smart alarming, event detection, and/or event mitigation. The smart alarming may be achieved by, for example, automating detection processes and using advanced signal processing techniques. Examples of such advanced signal processing techniques include rate of change analysis and reference learning.

In some applications, event detection is enhanced by combining different alarms to facilitate diagnosis of a condition, e.g. a pump condition. For example, the output signals of different types of sensors may be monitored for specific signal combinations indicative of an event that would benefit from an operational modification of the well system. In some applications, a controller, e.g. a suitable surface controller or other platform, may be programmed with alarm combinations using logical statements such as AND, OR, IF, NOT, and ELSE statements to create composite alarms. Additionally, the controller may be programmed to look for event signatures beyond a simple difference of the signal relative to a reference point. By way of example, the event signature detection may comprise detecting at least one of: signal patterns; rate of change in an individual signal or multiple signals; rate of change in a derived value based on multiple signals; rate at which a predicted signal deviates from a defined, learned, or predicted model; and other suitable event signatures.

The occurrence of certain unwanted events can be mitigated by automatically adjusting operation of a well system according to suitable protocols for a given event. Certain embodiments described herein utilize signal processing combined with well and equipment information to establish dynamic alarms. For example, the signal processing may use historical data and current operating conditions while the well and equipment information may comprise test data, pump details, and other data useful for analysis. In some applications, the adjustments to operation of an electric submersible pumping system or other type of well system may be automated.

Additionally, the alarm system may be combined with "safe mode" operation to facilitate event mitigation. According to an example, a smart alarm system is used to detect whether a parameter is within a determined safe range. If not, a control system detects the abnormal event and institutes a mitigation measure without stopping the pumping operation. The mitigation measure may be initiated in an automated manner, and the pumping operation is then further monitored to determine whether further mitigation should be used, whether the pumping operation should be stopped, and when normal operation may be resumed. The monitoring, alarming, and/or mitigation operations may be performed on various platforms, such as a local controller, a surface controller, a server, a supervisory control and data acquisition (SCADA) system, an office system via a satellite link, or other suitable platforms.

In various well applications, oil well installations may be equipped with control and monitoring equipment. For example, electric submersible pump installations may be equipped with control and monitoring equipment to monitor flow, pressure, temperature, electrical parameters, and/or other operational parameters. Such control and monitoring equipment comprises alarms that may be triggered when certain changes in operational parameters are detected by a control system. The control and monitoring systems may comprise controllers, e.g. microprocessors, which employ closed loop monitoring and control over well system operations. Depending on the application, the control and monitoring systems may be used to sense trigger levels, rates of change, signal patterns, and/or other indicators used in establishing dynamic alarm settings while avoiding false-positive alarms.

According to embodiments, the alarm system may include the capability of automatic alarm setting during startup of well equipment in which the alarm setting is based on pumping system specifications and information on local well conditions. Some embodiments may provide for alarm setting changes based on historical parameter measurements, including recent history and data from the current run of an oil well production cycle. Certain embodiments also may provide for alarm setting changes based on operational parameters other than the operational parameter for which the alarm is designated, e.g. flow measurements.

Referring generally to FIG. 1, an example of a well system 20 is illustrated as comprising a completion 22 deployed in a wellbore 24 which may be lined with a casing 26 having perforations 27. In this example, the well system 20 comprises an artificial lift system 28 in the form of an electric submersible pumping system. The electric submersible pumping system 28 may have a variety of components including, for example, a submersible pump 30, a motor 32 to power the submersible pump 30, a motor protector 34, and a sensor system 36, such as a multisensory gauge 38.

By way of example, the multisensory gauge 38 may be in the form of or comprise elements of the Phoenix Multisensor xt150 Digital Downhole Monitoring System™ for electric submersible pumps and manufactured by Schlumberger Technology Corporation. The multisensory gauge 38 may comprise sensors for monitoring downhole parameters, such as temperature, flow, pressure, electrical parameters, and various other parameters depending on the application. For example, the multisensory gauge 38 may have an intake pressure sensor 40 for measuring an inlet pressure of the electric submersible pumping system 28. A power source, such as a surface power source may be used to provide electrical power to the downhole components, including power to the submersible motor 32 via a suitable power cable or other conductor.

In this example, the motor 32 may be controlled with a variable speed drive (VSD) system 42. An example of the VSD system 42 is described in U.S. Pat. No. 8,527,219. The VSD system 42 may be used to provide a variable frequency signal to motor 32 so as to increase or decrease the motor speed.

The well system 20 also may comprise control and monitoring equipment 44 which is placed in communication, e.g. electrical communication, with desired sensors, such as multisensory gauge 38, a discharge pressure sensor 46, and/or other sensors positioned to detect desired parameters. The control and monitoring equipment 44 may be in the form of a processor, e.g. microprocessor, programmed to process sensor data according to desired algorithms, models, or other processing techniques. The control and monitoring equipment 44 may comprise a surface controller, a downhole controller, a server, an office system coupled through a satellite link or a variety of other types of communication systems, and/or a supervisory control and data acquisition (SCADA) system (examples of an SCADA system and other industrial control systems are described in US Patent Publication 2013/0090853).

The controller/monitoring equipment 44 is constructed to enable control of downhole components and monitoring of various downhole parameters via selected sensors. Control and monitoring equipment 44 may incorporate one or more processing units for executing software application instructions, storing and retrieving data from memory, and rapidly and continuously processing input signals from sensors, such as intake pressure sensor 40, discharge pressure sensor 46, a pump motor speed sensor 48, and/or a surface flow sensor 50. The equipment 44 also may output control signals to control various components, such as the pump motor variable speed drive system 42 and a pressure choke valve 52. In some applications, the control and monitoring equipment 44 may be coupled with environmental sensors 54 which are constructed for sensing environmental conditions.

The output signals from the various downhole sensors may be conveyed to the control and monitoring equipment 44 via a suitable communication line, such as a downhole wireline. Output control signals are generated by the processor or processors of equipment 44 according to algorithms, models, and/or other applications, and those output control signals are used to initiate automated procedures with respect to operation of the electric submersible pumping system 28, including control over the pump motor 32.

Control and monitoring equipment 44 also may comprise an operator interface 56 and an alarm management module 58 for processing information received from the various sensors, e.g. sensors 40, 46, 48, 50 and 54. The data received from the sensors may be received in real time and in a continuous manner to enable the alarm management module 58 to dynamically adjust alarm settings based on well conditions and environmental conditions. According to an embodiment, alarm management module 58 may comprise or cooperate with a memory 60 of control and monitoring equipment 44 which enable storage and retrieval of, for example, historical data. The historical data may be long-term historical data or short-term historical data, e.g. data from a current run cycle of the well. The alarm management module 58 also may be programmed to support or perform methods of dynamically setting alarms, as illustrated in the operational example of FIG. 2. Other data also may be stored in memory 60 of control and monitoring equipment 44, e.g. in alarm management module 58, and may include data representing different alarm levels.

According to an embodiment, control and monitoring equipment 44 may process signals from the various sensors, e.g. sensors 40, 46, 48, 50, 54, continuously and in real-time so as to provide closed loop control of various operating parameters associated with the electric submersible pumping system 28. The closed loop control of the electric submersible pumping system 28 may be utilized during, for example, commissioning and subsequent operation of the pumping system 28. By way of example, the closed loop control may include obtaining sensor readings for the sensed operating and environmental parameters. This information may be further utilized in the alarm management module 58 of control and monitoring equipment 44 to dynamically manage and set alarms.

Figure 2:
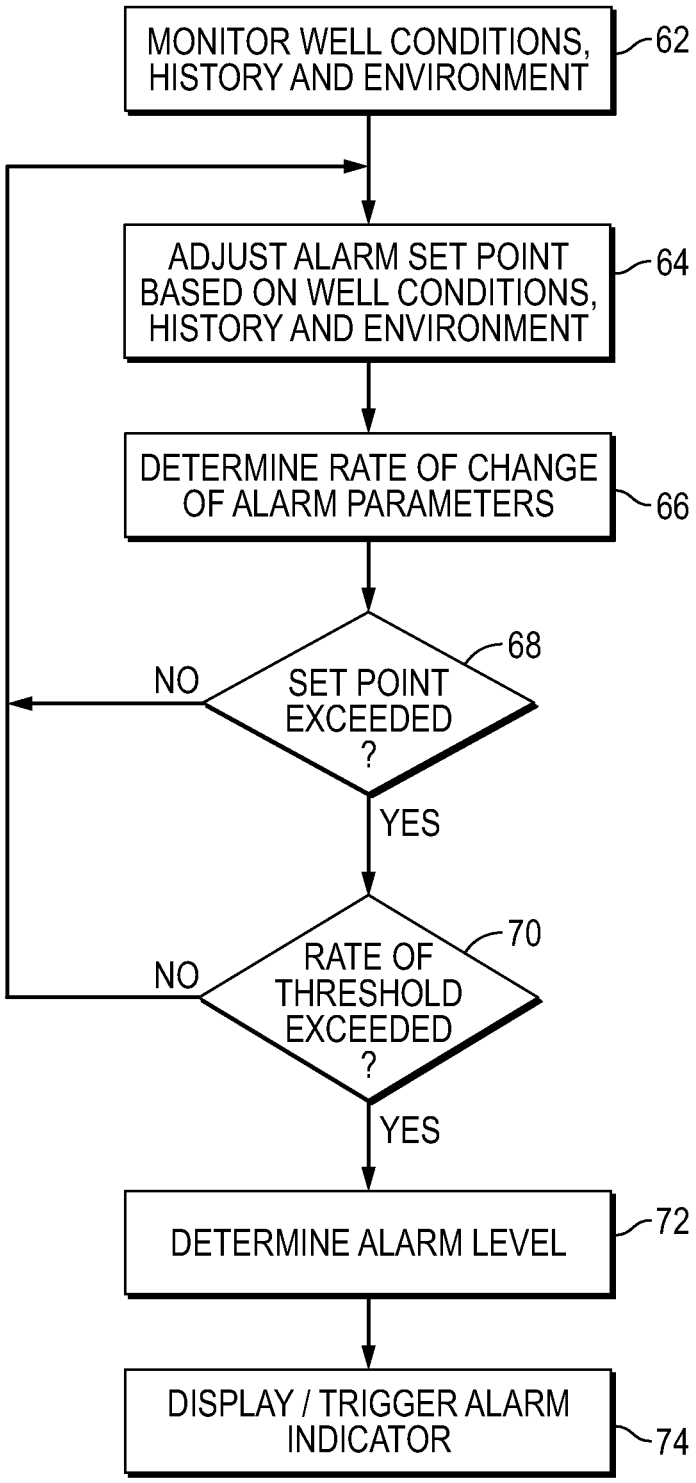
FIG. 2 is a flowchart illustrating an operational example employing the well system illustrated in FIG. 1, according to an embodiment of the disclosure.

Referring generally to FIG. 2, a flowchart is used to illustrate an example of a methodology for dynamically setting alarms. In this example, various data obtained from the sensors is stored. For example, well conditions, history data, and/or environmental conditions may be monitored and recorded/stored in memory 60, as represented by block 62. In this embodiment, alarm set points are dynamically determined based on the well conditions, history data, and/or environmental conditions, as represented by block 64. The processor of equipment 44 may be programmed to monitor a rate of change of alarm parameters to detect potentially anomalous or erroneous (e.g. false positive) alarm triggering input signals, data, or other information, as represented by block 66.

A determination is then made as to whether the initially established alarm set point has been exceeded, as represented by decision block 68. If the alarm set point has been exceeded, another determination is made as to whether a threshold rate of change for the particular parameter or parameters being monitored is exceeded, as represented by decision block 70. If the threshold rate of change has been exceeded, the risk of a false positive alarm is low and the process method proceeds to determine a particular alarm level, as represented by block 72. The particular alarm level may be selected according to an alarm level hierarchy, as explained in greater detail below. Once the particular alarm level is determined, the alarm is triggered and the alarm level/type is output, as represented by block 74. The output can be in the form of data displayed to an operator and/or control signals used to automatically adjust operation of the electric submersible pumping system 28. In some applications, low-level alarms may simply be flagged or used to initiate output of a suitable control signal which is sent by the system to an appropriate target control or other component.

If the set point or threshold at decision block 68 or decision block 70 has not been exceeded, the methodology directs a return to block 64 to again adjust alarm set points and to repeat the process. The methodology illustrated in the embodiment of FIG. 2 may be repeated in a high-speed and continuous manner by the control and monitoring equipment 44 via alarm management module 58.

Alarm management module 58 may be constructed, e.g. programmed, to classify alarms according to various hierarchies of alarm settings. By way of example, the hierarchy may comprise a high level or "danger" level alarm that results in immediate stoppage of the pumping system 28. A lower or "warning" level alarm may be used to indicate an issue which does not provide for immediate stoppage of an operation and may result in adjustment to the operation of the pumping system 28. A still lower level or "control" level alarm may be used to cause the output of a control signal which changes a control parameter related to operation of the electric submersible pumping system 28 but without providing, for example, notice to an operator. By way of example, such a "control" level alarm may cause the control and monitoring equipment 44 to change a speed of the pump 30 based on a change in sensed pressure, flow, temperature, electrical parameters, and/or other parameters. The alarm hierarchy also may comprise an "unreliable signal" alarm which indicates the basis for the alarm is not reliable and controls may not be responding appropriately.

The operator interface 56 may be used to display alarm information in a variety of formats. In some applications, the operator interface 56 is used to display the alarm information according to the hierarchy described above or according to another suitable hierarchy so that an operator may observe comprehensive status information on the system and on the alarm settings and status. In some applications, the operator interface 56 also may be used to input changes which allow the operator to classify alarm settings according to a desired hierarchy.

Sensed parameters may be used by the control and monitoring equipment 44 and alarm management module 58 to automatically establish alarm set points upon start-up of a well operation. Dynamic alarm settings may then be adjusted according to changing well and environmental conditions automatically and/or through the input of an operator. The methodology reduces or eliminates false positive alarms while providing a more comprehensive system and alarm status for an operator.

In an embodiment, a controller, e.g. control and monitoring equipment 44, may be programmed to provide safe operating modes so as to avoid tripping of the pumping system 28 to an off position. For example, in addition to a "trip" mode (in which the pump 30 and motor 32 are stopped due to an alarm condition) and a "log" mode (in which a condition is noted but no action is taken), the controller 44 may include an additional "safe" mode. The safe mode is a mode in which an automatic adjustment is made to the pumping system 28 to enable continued operation of the pumping system 28 in a limited capacity or with another appropriate adjustment to that operation. For example, the frequency of the variable speed drive system 42 may be changed to reduce the motor speed so that the motor 32 operates at a predetermined safe speed and direction.

The safe mode operation avoids a complete stop and subsequent restart of the pumping system 28. Avoidance of the stop and restart reduces the total number of starts to which the motor 32 and pump 30 are subjected, thus enhancing pumping system life. By maintaining the pumping system 28 in an adjusted, operating mode, the interruption to production also is reduced.

Various parameters may be monitored for determination of the appropriate alarm mode. Consequently, the sensor data processed by control and monitoring equipment 44 to determine whether safe mode operation should be initiated may vary depending on the specifics of a given application. For example, one monitored parameter may be the temperature of motor 32 referred to as Tm. If the controller 44 is programmed to initiate a trip mode alarm when Tm reaches a value X, then safe mode operation may be set to begin at a predetermined value less than X, e.g. 0.9X. By way of example, a rising Tm can be caused by gassy or sandy production, and safe mode operation can provide a mechanism to reduce total starts and to keep production interruptions to a minimum. However, the safe mode operation also may be used in connection with additional and/or other parameters, such as pressure, flow, other temperature readings, and/or other desired parameters.

Figure 3:
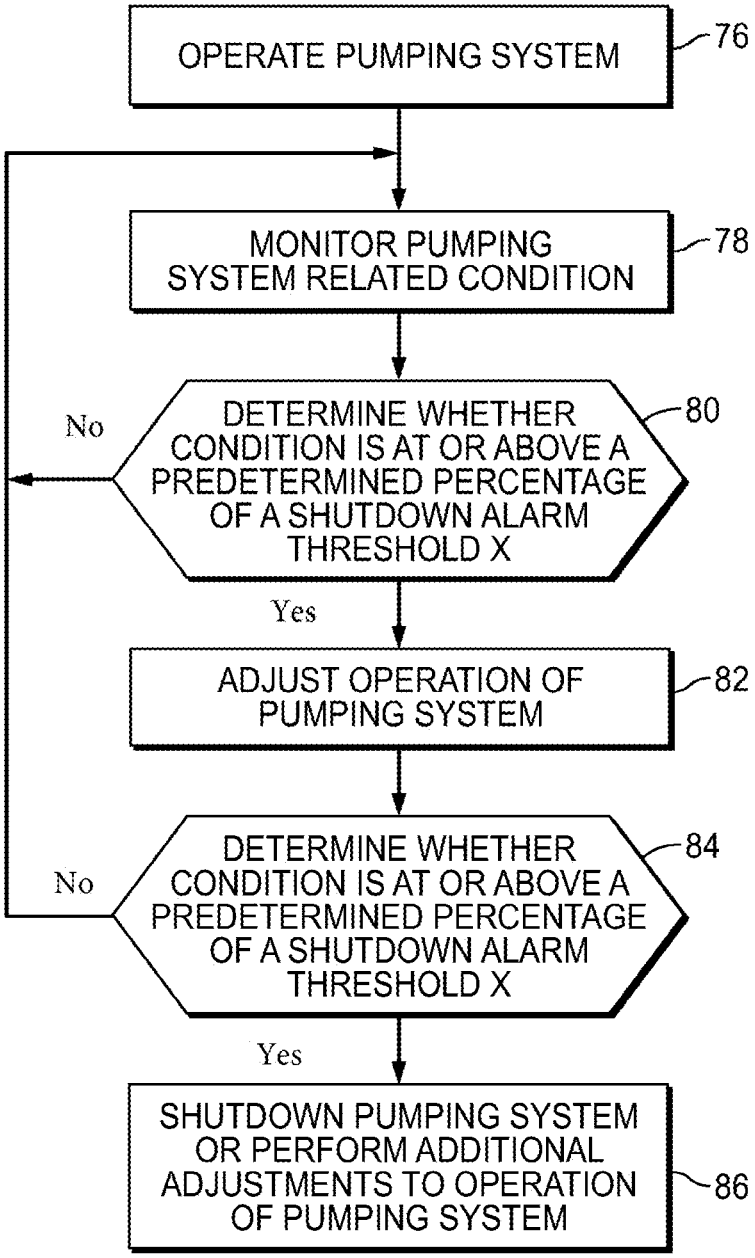
FIG. 3 is a flowchart illustrating an operational example employing event detection and event mitigation, according to an embodiment of the disclosure.

Referring generally to the flowchart of FIG. 3, an operational example is illustrated. In this embodiment, the pumping system 20 is started and operated, as represented by block 76. A parameter or condition is monitored by control and monitoring equipment 44 via the appropriate sensors, e.g. sensors 40, 42, 46, 50, 54, as represented by block 78. The controller 44 continually monitors the sensor data to determine whether the parameter/condition is above a predetermined percentage of X, as represented by decision block 80. If not, the monitoring is continued and no changes are made to the operation of the pumping system 28. However, if the sensor data indicates a level above the predetermined percentage of X, then an adjustment is made automatically to the operation of pumping system 28, e.g. the variable speed drive frequency is reduced to run motor 32 at a lower speed, as represented by block 82.

At this stage, the controller 44 again monitors the sensor data to determine whether the parameter/condition is above the predetermined percentage of X, as indicated by decision block 84. If not, the monitoring is continued with no further changes, as described above with reference to block 78. However, if the measured parameter/condition remains above the predetermined percentage, additional adjustments to the operation of pumping system 28 may be made, as indicated by block 86. If, however, level X is reached or if the level remains above the predetermined percentage for longer than a predetermined time period, the pumping system 28 may be shut down. In many applications, normal operation may be resumed after the event, e.g. abnormal parameter, has passed or after an operational adjustment has been performed.

In another embodiment, a controller, e.g. control and monitoring equipment 44, may be programmed to provide an advanced alarming technique that defines alarm conditions dependent on more than a single parameter. In other applications, the advanced alarming technique may comprise defining alarm conditions which are based on historical trend data of a measured parameter instead of a single instantaneous sample. This type of advanced alarming technique can be used to provide better protection and increased longevity of the pumping system 28. For example, the advanced alarming technique can be used to recognize harmful conditions which would otherwise go unnoticed, and these conditions can be acted on by tripping the pumping system 28 to a stopped position, by logging the condition as part of a continual effort to optimize production, and/or to initiate an altered mode, e.g. safe mode, of operation with respect to the pumping system 28.

In a specific embodiment, the advanced alarming technique may utilize a composite alarm which is based upon more than a single live value of sensor data. For example, logical operators such as AND, OR, NOT, ELSE and IF may be used to chain together multiple single alarms into a composite alarm condition. The processor of control and monitoring equipment 44 may be programmed to monitor for the desired combination of sensor data signals obtained from the relevant sensors. By way of example, a combination of sensors and sensor data may be used to indicate a condition of gas lock. No single measurement is effective at measuring gas lock, but a combination of live values, e.g. motor load data, motor temperature data, and flow data, can be used to provide the indication of gas lock. For example, these three types of data can be logically chained together to indicate gas lock is present if the motor load is too low AND the motor temperature is too high AND the flow is too low.

In another specific embodiment, the advanced alarming technique may utilize a behavior alarm which examines the behavior of live value readings. For example, control and monitoring equipment 44 may be programmed to obtain a sampling of live values represented by sensor data so that the slope of the live parameter can be checked. In other words, the advanced alarming technique monitors for harmful conditions based on historical trend data rather than simple instantaneous readings of the sensor data.

Many parameters monitored by the sensors, e.g. sensors 40, 46, 48, 50, 54, remain fairly constant during stable operating conditions with respect to electric pumping system 28. Accordingly, a sufficiently large discontinuity or excessive ripple in the sensor data/values may indicate a pending problem even if the absolute value of the live reading has not yet exceeded predetermined maximum alarm set points or limits.

Figure 4:
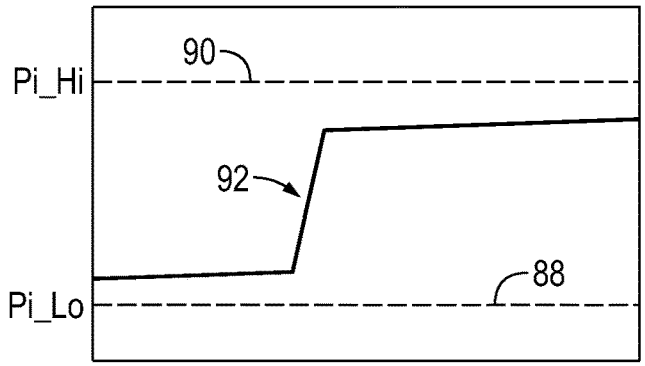
FIG. 4 is a diagram of a monitored signal which enables detection of an alarm event based on a pattern in the monitored signal, according to an embodiment of the disclosure.

As illustrated in the graphical example of FIG. 4, the control and monitoring equipment 44 may be programmed to output an alarm if sensor data crosses a lower alarm limit 88 or an upper alarm limit 90. For example, a pressure or pressures associated with operation of the electric submersible pumping system 28 may be tracked and an alarm alert may be output if the pressure falls below lower limit 88 or rises above upper limit 90. However, a discontinuity 92 in the live values, e.g. pressure readings, provided by the appropriate sensors also may be indicative of an alarm condition. The control and monitoring equipment 44 is programmed to detect predetermined discontinuities 92 which merit output of an alarm condition. As described above, the alarm condition level may vary depending on the specific discontinuity 92 detected.

In another operational embodiment, the electric submersible pumping system 28 is protected by monitoring parameters, e.g. motor current, motor voltage, and/or other parameters, related to operation of the electric submersible pumping system 28. When the monitored parameters cross predetermined alarm thresholds, operation of the electric submersible pumping system 28 is adjusted, e.g. motor speed is slowed. If maximum or extreme alarm thresholds are crossed, operation of the pumping system 28 may then be stopped.

During a variety of downhole pumping applications, the electric submersible pumping system 28 is vulnerable during initial start-up and ramp-up phases and during periods of changing load. The changing load may result from fluid composition changes, e.g. solids, gas, water, and oil composition changes, and/or specific gravity changes resulting from changing well conditions or other phenomena.

The motor 32 of electric submersible pumping system 28 may be protected during these phases and during changing loads by adjusting alarm thresholds. The alarm thresholds may be adjusted by generating and maintaining over time a model of the motor's electrical inputs, e.g. voltage, current, and frequency, versus the expected pump outputs of pumps 30. When the monitored data crosses certain alarm thresholds by deviating from the model, appropriate adjustments may be made, such as modifying the rotational speed of the motor 32, including full stoppage of the motor 32 under certain conditions. Tracking of the system behavior over time enables the model and the associated alarm thresholds to be dynamically adjusted, e.g. to evolve. The evolving occurs over the operational life of the electric submersible pumping system 28 and the surrounding reservoir as, for example, equipment degrades and well conditions and reservoir fluids change.

Figure 5:
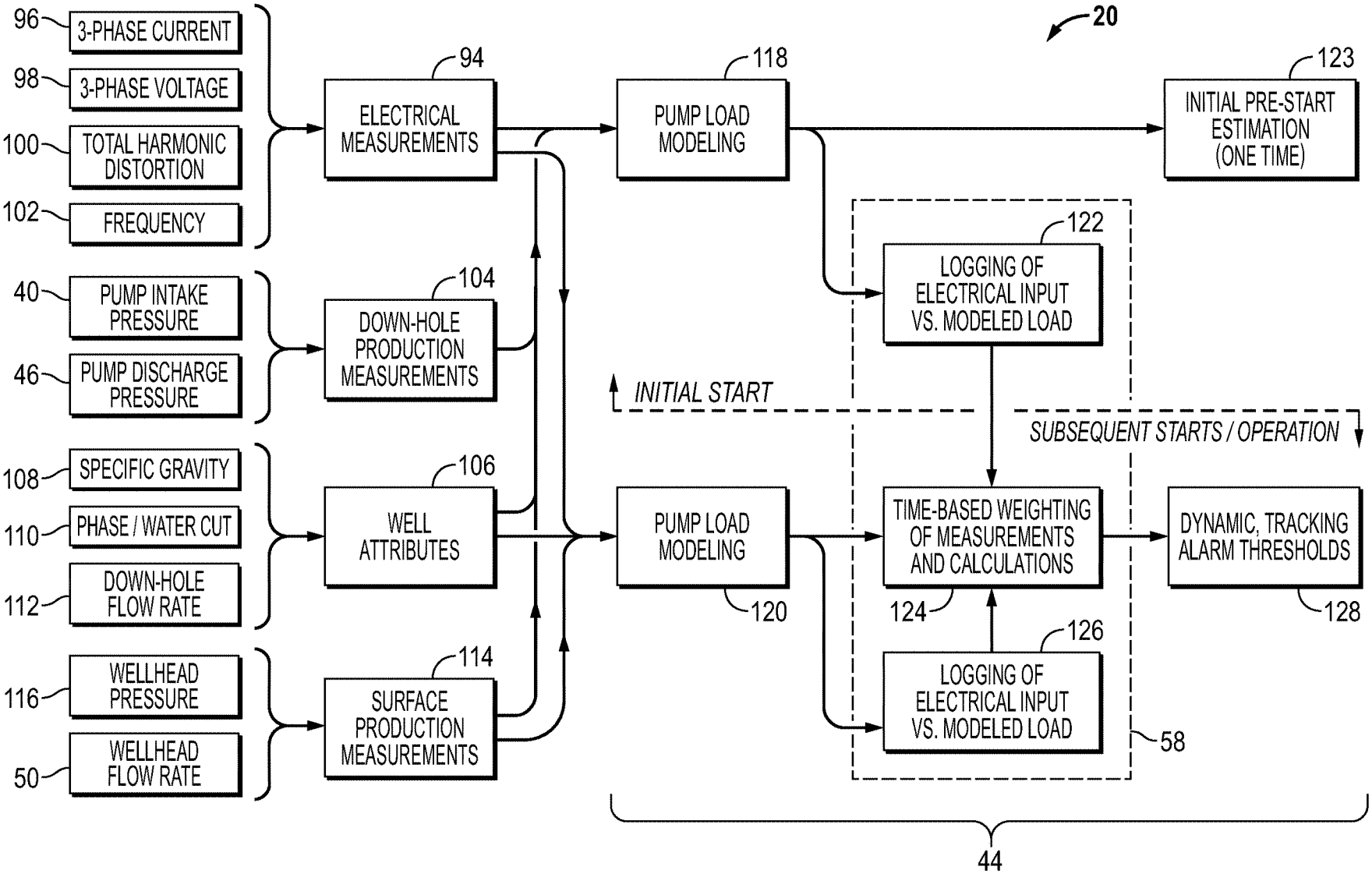
FIG. 5 is a schematic illustration of a well system utilizing a plurality of sensors providing data to a control system which, in turn, to dynamically adjusts alarm thresholds, according to an embodiment of the disclosure.

Referring generally to FIG. 5, an embodiment of well system 20 is illustrated in which data is monitored and modeled to both establish alarm thresholds and to dynamically adjust those alarm thresholds over time. In this example, the control and monitoring equipment 44 again receives a variety of data related to operation of the electric submersible pumping system 28 or other artificial lift system. By way of example, the control and monitoring equipment 44 may receive electrical measurements 94 obtained from appropriate sensors, such as three-phase current sensors 96, three-phase voltage sensors 98, harmonic distortion sensors 100, frequency sensors 102, and/or other suitable sensors.

Additionally, downhole production measurements 104 may be received from suitable sensors, such as a pump intake pressure sensor 40 and the pump discharge pressure sensor 46. A plurality of well attribute measurements 106 also may be received from suitable sensors, such as specific gravity sensors 108, phase/water cut sensors 110, and downhole flow rate sensors 112. Similarly, surface production measurements 114 may be obtained from suitable sensors, such as a wellhead pressure sensor 116 and surface or wellhead flow rate sensor 50.

The data from the various sensors may be delivered to control and monitoring equipment 44 for appropriate processing according to desired algorithms, models, and/or other processing techniques. For example, the sensor data may be modeled by an initial-start, pump-load, modeling module 118. Following the initial start, the sensor data may be modeled by a subsequent-start/operational, pump-load modeling module 120.

In this example, the alarm management module 58 or other suitable processing module may be used to establish a log 122 of electrical inputs versus modeled load based on data from the initial start module 118. In some applications, the data from module 118 may further be used to establish an initial pre-start estimate 123. The alarm management module 58 also may be employed to provide a time-based weighting 124 of the measurements and calculations based on data from the subsequent start/operation module 120 and from the log 122. The time-based weighting 124 also receives log data 126 of electrical inputs versus modeled load. (The log data 126 is obtained from the subsequent-start/operation module 120.) Based on this collection of data and modeling of data, the time-based weighting 124 of measurements and calculations can be used to establish and dynamically adjust alarm thresholds 128.

Figure 6:
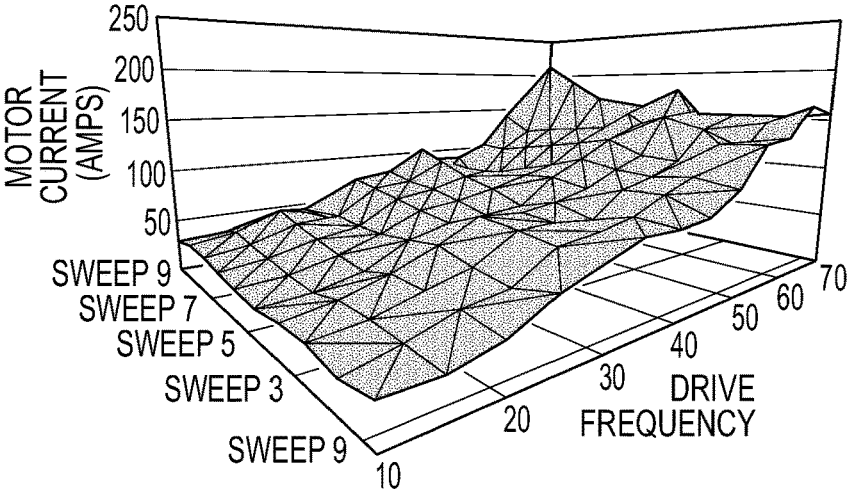
FIG. 6 is a graphical illustration of changing parameter data which may be used to adjust alarm thresholds for an electric submersible pumping system, according to an embodiment of the disclosure.
Figure 7:
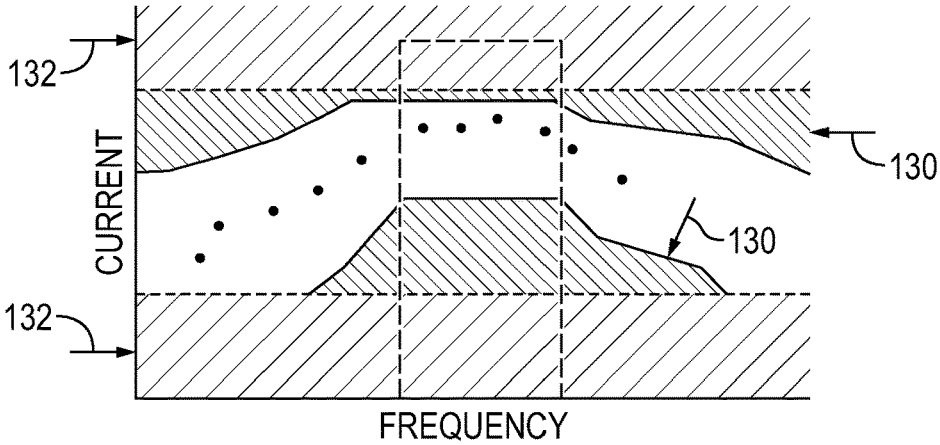
FIG. 7 is a graphical illustration of dynamic adjustment of alarm thresholds during operation of a well system, according to an embodiment of the disclosure.

The alarm thresholds 128 may be adjusted via control and monitoring equipment 44 throughout the life and operation of electric submersible pumping system 28. This allows the control and monitoring equipment 44 to adjust operation of the pumping system 28 as appropriate for a given set of conditions related to operation of the pumping system 28 and/or conditions related to the well and surrounding reservoir. For example, the system enables tracking data, storing data, and modeling data related to motor current and motor frequency over time, as shown graphically in FIG. 6. As illustrated, the data changes over time as electric submersible pumping system 28 is continuously operated. The control and monitoring equipment 44, however, may adjust to these changes and, in turn, dynamically adjust alarm thresholds, as indicated by arrows 130 in FIG. 7.

In this example, the alarm thresholds indicated by arrows 130 are adjusted relative to initial thresholds indicated by arrow 132. However, the data may be modeled or otherwise processed to determine a plurality of alarm threshold levels which may be used to output appropriate control signals for adjusting operation of pumping system 28, stopping operation of pumping system 28, and/or outputting appropriate alarm indicators to an operator.

According to embodiments described herein, the smart alarming techniques may utilize static data, modeling, actual measurements, and/or other data to determine alarm conditions. In some applications, signal processing is used to automatically determine reference levels as well as alarm levels for a single sensor signal or a combination of sensor signals. The processing system of control and monitoring equipment 44 may be used to apply a raw parameter measurement, a calculated/modeled parameter, or a combination of raw parameter measurements and other parameter data. Various signal processing techniques, e.g. rate of change techniques, may be used to detect alarm conditions and, in some applications, to automatically adjust operation of the electric submersible pumping system or other artificial lift system.

For example, the control and monitoring equipment 44 and the associated sensors and modules may be used for event detection and mitigation based on single alarms or combinations of smart alarms. The equipment 44 may be programmed to use event specific signal processing which analyzes the timing of the event, scale of the event, and/or other data to determine whether an alarm action and/or mitigating action should be taken with respect to operation of the pumping system 28. For example, the control and monitoring equipment 44 may be used to apply a mitigation protocol which depends on the type of event detected. In many applications, the control and monitoring equipment 44 learns from the history of the well and the impact of previous mitigation measures, thus enabling the system to dynamically adapt various smart alarms according to the mitigation protocol.

Depending on the application, the well system 20 and artificial lift system 28 may have a variety of configurations and comprise numerous types of components. Additionally, various sensors and combinations of sensors may be employed. The procedures for obtaining and analyzing the data also may be adjusted according to the parameters of a given well, completion system, and/or reservoir. Similarly, the control and monitoring equipment 44 may be programmed to detect various events, trends, discontinuities, and/or other changes in the data from individual or plural sensors to determine an alarm condition. The equipment 44 also may be used to determine various levels of alarm which may be output to an operator and/or used to initiate automatic adjustments to operation of pumping system 28. Various closed loop control strategies may be used to continually monitor operation of the pumping system following the adjustments so as to determine future actions with respect to operation of the pumping system.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method for providing an alarm in a well based on event detection, the method comprising:

receiving, via control and monitoring equipment, well system data;

receiving, via the control and monitoring equipment, a predetermined combination of sensor data from a plurality sensor devices of a downhole sensor monitoring operation of an electric submersible pumping system;

processing, via the control and monitoring equipment, the well system data and the sensor data;

determining, that a data set exceeds an alarm threshold, the data set comprising at least one of the well system data or the sensor data;

dynamically adjusting, via an alarm management module, the alarm threshold for a parameter monitored using at least one of the sensor devices according to changes in the sensor data;

in response to determining that the data set exceeds the alarm threshold, determining that a rate of change value of the data set exceeds a rate of change threshold;

in response to detecting the rate of change value exceeding the rate of change threshold, automatically adjusting, via the control and monitoring equipment, operation of the electric submersible pumping system according to the well system data and the sensor data; and providing an alarm in response to detecting the rate of change value exceeding the rate of change threshold, wherein the alarm signal indicates a level of a plurality of levels, wherein the levels comprise a first level where a speed of the electrical submersible pumping system is automatically adjusted without stopping the electrical submersible pumping system and a second level where the electrical submersible pumping system is automatically stopped.

2. The method of claim 1, wherein the method further comprises setting, via the alarm management module, a plurality of alarm threshold levels.

3. The method of claim 1, wherein:

the alarm threshold includes an upper threshold and a lower threshold; and the alarm is output in response to via discontinuity in sensor data occurring between the upper alarm threshold and the lower alarm threshold.

4. The method of claim 1, wherein receiving the predetermined combination of sensor data comprises receiving pressure data.

5. The method of claim 1, wherein receiving the predetermined combination of sensor data comprises receiving temperature data.

6. The method of claim 1, further comprising using closed-loop control to continually monitor and adjust operation of the electric submersible pumping system.

7. The method of claim 1, further comprising dynamically adjusting the alarm threshold and automatically adjusting operation of the electric submersible pumping system, without operator intervention, during operation of the electric submersible pumping system.

8. The method of claim 1, wherein dynamically adjusting an alarm threshold for the parameter comprises:

generating a predictive model of operation of the electric submersible pump, the predictive model comprising a predicted value of the parameter at which the electric submersible pump with incur an event;

comparing the received sensor data with the predicted value of the parameter to determine a deviation from the predicted value; and dynamically adjusting the predicted value of the parameter based on the deviation to generate the alarm threshold.

9. The method of claim 1, wherein the well system data includes historical data indicating operation of the electric pumping system.

10. A method for providing an alarm in a well based on event detection, the method comprising:

receiving, via control and monitoring equipment, well system data;

receiving, via control and monitoring equipment, sensor data based on at least one well condition;

establishing, via an alarm management module, an alarm set point and an alarm rate of change (ROC) set point based at least in part on the well system data and the sensor data;

receiving an indication that the alarm set point has been exceeded;

in response to receiving the indication that the alarm set point has been exceeded, receiving an indication that the ROC set point has been exceeded;

in response to receiving both the indication that the alarm set point and the ROC set point have been exceeded, outputting, via the control and monitoring equipment, an alarm signal indicating an event has occurred;

in response to outputting the alarm signal, providing instructions to the control and monitoring equipment to enter a safe operation mode to facilitate mitigation of the event according to the well system data and the sensor data;

automatically adjusting, via the control and monitoring equipment, operation of an electric submersible pumping system based on the alarm signal, wherein the alarm signal indicates a level of a plurality of levels, wherein the levels comprise a first level where a speed of the electrical submersible pump is automatically adjusted of without stopping the electrical submersible pump and a second level where the electrical submersible pump is automatically stopped.

11. The method of claim 10, wherein receiving sensor data comprises monitoring a well condition related to operation of an electric submersible pumping system.

12. The method of claim 10, wherein receiving sensor data comprises monitoring a plurality of well conditions.

13. The method of claim 10, wherein outputting the alarm signal comprises outputting an alarm to an operator.

14. The method of claim 10, wherein automatically adjusting operation of the electric submersible pump comprises reducing a motor speed of a motor in the electric submersible pumping system.

15. The method of claim 10, wherein establishing an alarm set point and an alarm ROC set point comprises establishing a rate of change of at least one of pressure and temperature monitored downhole.

16. The method of claim 10, further comprising performing closed-loop control to continually monitor and adjust operation of the electric submersible pumping system.

17. A system for providing an alarm during a well operation, the system comprising:

an electric submersible pumping system positioned in a well for pumping fluid;

a plurality of sensors for sensing parameters related to pumping the fluid; and an alarm management module, the alarm management module configured to:

receive data related to a current condition of at least one of the well and the electric submersible pumping system;

process the data;

automatically adjust an alarm threshold in response to determining that the data exceeds the alarm threshold; and automatically adjust a rate of change (ROC) threshold in response to determining that a rate of change value of the data exceeds a rate of change threshold; and output an alarm signal in response to:

determining that the data exceeds the alarm threshold; and determining that the rate of change value of the data exceeds the rate of change threshold;

wherein the alarm signal is used to automatically adjust operation of the electric submersible pumping system according to the well system data and the sensor data, wherein the alarm signal indicates a level of a plurality of levels, wherein the levels comprise a first level where the alarm signal causes a speed of the electrical submersible pumping system to be automatically adjusted without stopping the electrical submersible pumping system and a second level where the alarm signal causes the electrical submersible pumping system to be automatically stopped.

18. The system of claim 17, wherein the alarm signal is displayed to an operator.

19. The system of claim 17, wherein the alarm threshold is based on a data discontinuity occurring between a pair of alarm thresholds.

20. The system of claim 17, further comprising control and monitoring equipment configured to use closed-loop control to continually monitor and adjust operation of the electric submersible pumping system.

* * * * *